United States Patent [19]

Cole

[11] 4,145,463

[45] Mar. 20, 1979

[54] FLAMEPROOFING OF TEXTILES

[75] Inventor: Robert Cole, Dudley, England

[73] Assignee: Albright & Wilson Limited, Worcester, England

[21] Appl. No.: 389,487

[22] Filed: Aug. 20, 1973

[30] Foreign Application Priority Data

Aug. 21, 1972 [GB] United Kingdom ..... 38845/72
Feb. 9, 1973 [GB] United Kingdom ..... 06490/73

[51] Int. Cl.[2] ..... B05D 3/04; B05D 3/10
[52] U.S. Cl. ..... 427/337
[58] Field of Search ..... 117/62.2, 136, 137, 117/143 R, 106 R; 118/48, 49; 68/5 E; 427/348, 342, 345, 337

[56] References Cited

U.S. PATENT DOCUMENTS

| | | | |
|---|---|---|---|
| 2,676,564 | 4/1954 | Gray | 117/106 R |
| 2,772,188 | 11/1956 | Reeves et al. | 117/136 |
| 2,785,651 | 3/1957 | Pawlyk | 117/107.1 |
| 2,818,351 | 12/1957 | Nack et al. | 117/107.1 |
| 3,096,201 | 7/1963 | Coates et al. | 117/62.2 |
| 3,281,258 | 10/1966 | Callahan | 427/348 X |
| 3,547,683 | 12/1970 | Williams et al. | 117/106 R |
| 3,607,356 | 9/1971 | Beninate et al. | 117/62.2 |

*Primary Examiner*—Bernard D. Pianalto
*Attorney, Agent, or Firm*—Flynn & Frishauf

[57] ABSTRACT

A process for flameproofing cellulosic fabrics which comprises impregnating the fabric with an aqueous solution of a THP salt with or without condensation with a nitrogen-containing compound, and treating the impregnated fabric with ammonia to produce a cured resin, wherein the treatment with ammonia is carried out by passing the impregnated fabric through seals into and out of a closed chamber and in contact with at least one duct located in the chamber and having one or more orifices through which gaseous ammonia is caused to issue and pass through the fabric over its width, the chamber being provided with means to prevent condensed water formed by evaporation and/or chemical action from dripping on to the fabric.

15 Claims, 1 Drawing Figure

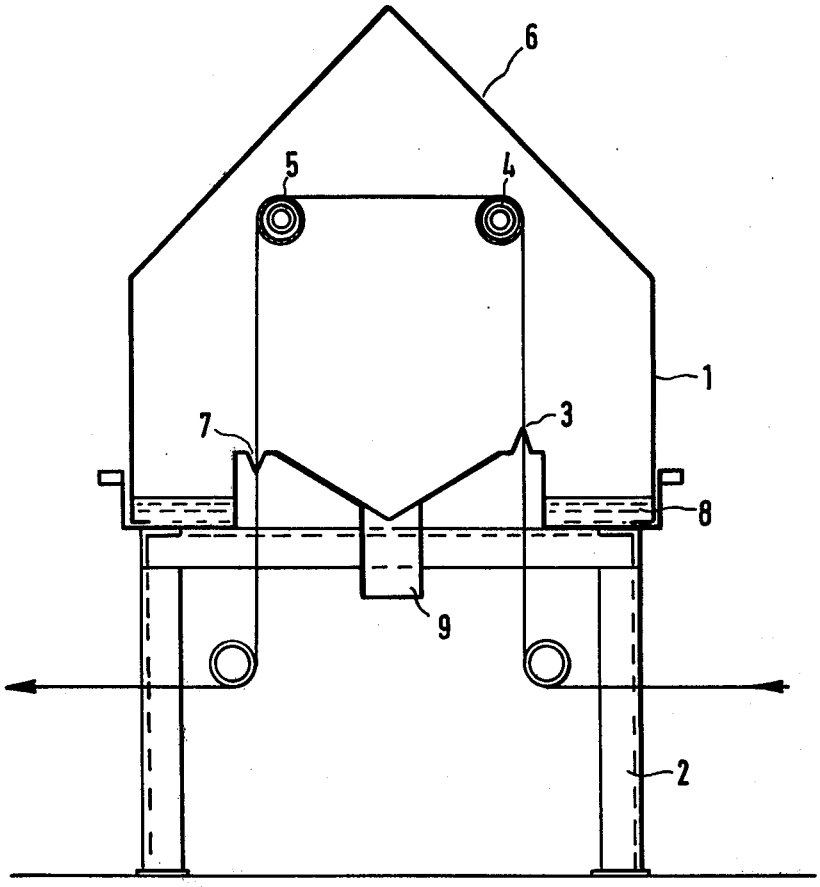
6
5
4
1
7
3
8
9
2

FLAMEPROOFING OF TEXTILES

This invention relates to a treatment of cellulosic textile fibres to render them flame-resistant. Such treatments are referred to herein for convenience as 'flameproofing' treatments notwithstanding that they may not completely inhibit all flame formation. The treatment to which the invention relates is that in which the fibres are impregnated with a tetrakis hydroxymethyl phosphonium salt (hereinafter called a THP salt, or THPC in the case of the chloride) with or without condensation with a nitrogen-containing compound, and are then treated with ammonia. In this way a cross-linked polymer is formed on the fibres and renders them flame-resistant.

A process of the kind described above was disclosed in U.S. Pat. No. 2,772,188, but met with the difficulties that if gaseous ammonia was used for the cure an adequate degree of cross-linking was not obtainable in a reasonable time, while if aqueous ammonia was used the initial polymer deposited on the fibres from the impregnating solution was caused to migrate away from the fibres into the aqueous ammonia. The solution to this problem which gained commercial acceptance was the subject of UK Patent specification No. 906,314, according to which the ammonia is applied in two stages: first as gaseous $NH_3$ and second as aqueous ammonia.

In the practical application of the last-mentioned process, the impregnated and dried fabric is first passed through a large diffusion chamber containing ammonia gas, and then through a bath of aqueous ammonia. While giving highly successful results, the process necessitates two stages of operation and the gaseous phase is somewhat time-consuming. The proceedings of the 1st International Cotton Research Conference, Paris, April 1969 pp 721–733 describes a laboratory study of the curing with ammonia of THP polymers for flameproofing textiles, and refers to a method of applying gaseous ammonia by injecting it under pressure through nozzles in tubes over which the fabric was passed. The tubes were located in a vessel having a good exhaust system. We have found in attempting to repeat these experiments that if ammonia is supplied at a sufficiently high rate, the cure is effected more quickly than is possible using the earlier two-stage 'gaseous/aqueous' process.

We further found that the amount of ammonia necessary in order to produce a cured resin which is reasonably wash-fast on the fabric is related to the THP or phosphorus content of the pre-condensate present, and that if the system described in the Conference Proceedings is used, the molar $NH_3/P$ ratio must be at least 6:1. However we found that the nitrogen content of the final resin is no higher than when curing is carried out by a diffusion curing method, indicating that most of the ammonia gas passes through the fabric without reacting and is removed in the exhaust system.

The present invention is based on our discovery that it is possible to obtain rates of cure considerably faster than those stated in the Conference Proceedings but with a much reduced usage of ammonia, which may be no greater than that required in the diffusion process. According to the invention, the impregnated fabric is passed through seals into and out of a closed chamber and travels in contact with at least one duct having one or more orifices through which gaseous ammonia is caused to issue, and pass through the fabric over its width, the chamber being provided with means to prevent condensed water formed by evaporation and/or chemical reaction from dripping on to the fabric.

The impregnated solution may be a THP salt or any of the large number of known pre-condensates of a THP salt and a nitrogen-containing compound as described for example in UK Patent specification Nos. 740,269 which discloses melamine, guanidine, and urea. Examples of nitrogen-containing compounds are also disclosed in UK Patent specification Nos. 906,314 which discloses urea; and 761,985 which discloses the nitrogen-containing compounds as follows:

"a nitrogen-containing polyfunctional compound capable of reaction with a formaldehyde, by virtue of the presence in the molecule of more than one hydrogen atom attached to nitrogen or hydrogen linked to carbon on an aromatic nucleus, and/or an initial or early reaction product of such a nitrogen-containing compound and an aldehyde.

"It will be understood that more than one nitrogen-containing polyfunctional compound capable of reaction with formaldehyde may be used in the reaction.

"Examples of suitable nitrogen-containing compounds are those corresponding to one or other of the following formulae:

(1) $R_1$—$NH_2$ and (2)

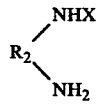

in which $R_1$ is —CN, —$NH_2$, —$SO_2.NH_2$, —$SO_2$.OH, or —NH.CO.NH.$NH_2$; $R_2$is NH=C< or O=C<; and X is —CN, —$NH_2$, —$CONH_2$,

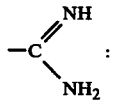

—CO.NH.CO.$NH_2$, —CO.NH.CO.NH.CO.$NH_2$, —NH.CO.$NH_2$, or —CO.NH.$NH_2$. Compounds of formula (1) are, by name, cyanamide, hydrazine, sulphamide, sulphamic acid and carbohydrazide.

"Compounds according to formula (2) are dicyandiamide, aminoguanidine, guanylurea, biguanide, amino dicyandiamidine, cyanourea, semicarbazide, biuret, triuret, tetrauret, biurea and amino biuret.

"Salts of the aforesaid compounds with acids may be used in the reaction.

"Other examples of nitrogen-containing compounds are primary aliphatic and alicyclic amines, aliphatic and alicyclic primary and secondary polyamines and aromatic primary, secondary and tertiary amines and polyamines, for example, tertiary octylamine, cyclohexylamine, ethylene diamine, aniline, diphenylamine, and benzyl ethyl aniline.

"Further examples are ammonia and hexamethylene tetramine.

"Still further examples of suitable nitrogen-containing compounds are alkyl and aryl amides, for example, adipamide, acrylamide, butyramide and phthalic acid diamide." If a THP salt without a nitrogen-containing compound is used, it should be partially neutralised as described for example, in UK Patent specification No. 938,990. We prefer, however, to use a pre-condensate of a THP salt with urea, advantageously in the proportions referred to in our UK patent Application No. 37634/72 which discloses a ratio of urea to THP salt between 0.05:1 and 0.25:1 molar. The THP salt is normally the chloride but other halides such as the bromide, or other salts such as the acetate, sulphate or phosphate, may be used.

The preferred rate of feed of the ammonia is such that 1.5–2.5 moles are provided for every mole of THP present in the fabric. We find that in this range the system remains in a state of balance, with the supply of ammonia equal to the chemical usage of 1–1.5 moles plus the physical loss due to solution of ammonia in water present in the chamber, for example for sealing purposes, and any leakage. In these conditions the chamber contains a mixture of air and ammonia and this, together with the gas forced through the fabric from the orifices, effects a rapid and substantially complete cure. This is in contradistinction to the process of the Conference Proceedings in which, according to a later publication (Textile World, October 1972, pp 129–132), the cure requires further reaction with ammonia absorbed in the fabric. However, if the ammonia supply in the process of our invention is too low, the concentration of ammonia in the chamber falls and incomplete fixation is obtained. If, on the other hand, the supply is increased beyond that needed to maintain the desired concentration, the pressure builds up and the rate of supply should be decreased accordingly.

The rate of supply of ammonia per unit of time depends on the speed at which the fabric is passed through the chamber and this in turn must depend on the rate at which the cure takes place. We have found that when using the process and apparatus of the invention, the rate of curing is such that the fabric can be passed through at a speed likely to be required to phase in the treatment with other fabric processing operations, for example 20–30 yards/minute.

In another aspect the invention consists in apparatus for carrying out the invention. Such apparatus is illustrated by way of example by the accompanying drawing, which is a diagrammatic vertical section of a reaction chamber. The reaction chamber 1 is mounted on a base 2. The fabric enters the chamber through a seal 3 and passes over two perforated tubes 4 and 5 through which ammonia gas issues. Instead of perforations, the tubes may have a series of slots, or a single slot extending over the length of the tube. Considerable ammounts of heat and water vapour are produced in the reaction and water condenses on the cooler areas inside the chamber. This water must not be allowed to drip onto the fabric as this gives rise to the formation of white spots or rings of polymer on the fabric surface. The chamber must be designed so that this condensation drains away without dripping on the fabric. In the example shown, this is effected by providing the chamber with a sloping roof 6. Where the curing chamber is designed to accommodate wide fabrics and is being used to process narrow fabrics it is advisable to insert suitable plates (not shown) to blank out the area of gassing slots or perforations which are not covered by the fabric, to ensure that all the gas input passes through the fabric.

The fabric leaves the chamber through seal 7. The seals 3 and 7 may each consist of rubber lips with a narrow gap between them and it will be understood that the word 'seal' does not connote a closure which is necessarily 100% gastight.

The chamber is sealed by a water trough 8, which also serves to collect water containing ammonia in solution which is condensed during operation. Preferably the trough contains cool running water, which ensures that condensation takes place at the bottom rather than the top of the chamber. In addition a drain 9 is provided.

The ammonia is preferably fed to the tubes at ambient temperature. The fabric may enter the chamber with considerable water content, as the heat of reaction will cause the water to evaporate. It is, however, preferred to dry off most of the impregnating water before the ammonia cure so that the water content of the fabric on entering the chamber is 5–15%. On leaving the chamber the fabric is fully cured and can be passed straight to an oxidising scouring treatment.

The invention is illustrated by the following Examples:

EXAMPLE 1

Samples of a cotton winceyette fabric weighing 150g/sq m were padded through solutions of a THPC/urea pre-condensate to give a pick-up of about 25% THPC on the fabric. The fabric was dried and then cured in apparatus similar to that shown in the drawing by passing over a perforated roller through which ammonia gas was fed at varying rates. After curing the fabric samples were washed off in 5% 100 volume hydrogen peroxide solution.

For comparative purposes the above was repeated using apparatus for curing which differed from that of the present invention, in that the chamber was ventilated by an exhaust fan.

The % solid fixation, ie the weight increase of the fabric after treatment expressed as a % of the THPC/urea solids content applied to the fabric, is related to the ratio of ammonia passed through the fabric, expressed as moles $NH_3$ per mole P present, as shown in Table 1.

Table 1

| | Ammonia Flow Rate moles/mole P | % Solid Fixation |
|---|---|---|
| System A Exhausted (Comparative) | 2.94 | 57.8 |
| | 4.12 | 64.8 |
| | 5.16 | 71.0 |
| | 6.87 | 71.3 |
| | 12.8 | 74.6 |
| | 16.0 | 75.8 |
| System B Sealed (According to Invention) | 0.44 | 56.9 |
| | 1.37 | 63.1 |
| | 2.26 | 71.8 |
| | 3.07 | 72.5 |
| | 4.20 | 73.5 |

With both systems a certain level of flowrate is required in order to obtain maximum solid fixation and further increase in flowrate does not improve upon this result. In the case of the exhausted system the flow required is about 5.2 moles $NH_3$/mole P but with the sealed system it is only 2.3 moles $NH_3$/mole P.

EXAMPLE 2

Cotton winceyette fabric was treated as in Example 1 but using a treatment bath containing 25.6% THPC buffered to a pH of 6 by addition of 1.6% NaOH. Higher ammonia gas flowrates were required to obtain complete fixation with THPC as compared with the THPC/urea precondensate, but again the sealed system required lower flowrates than the exhausted system (about 7 moles $NH_3$/mole P compared with 13 moles $NH_3$/mole P). The results are shown in Table 2.

Table 2

| | $NH_3$/P ratio | % Solid Fixation |
|---|---|---|
| System A Exhausted | 4.0 | 41.0 |
| | 6.8 | 47.3 |
| | 10.1 | 60.6 |
| | 13.1 | 69.2 |
| | 16.5 | 69.9 |
| System B Sealed | 2.6 | 44.8 |
| | 3.6 | 58.5 |
| | 7.3 | 74.1 |
| | 9.7 | 72.8 |
| | 11.4 | 73.8 |

EXAMPLE 3

A cotton winceyette fabric weighing 150g/sq m was padded in a solution of a THPC/urea pre-condensate to give an uptake of 25.0% THPC and tenter dried. It was cured by passing through a sealed unit containing two perforated tubes over which the fabric passed and through which ammonia gas was introduced into the chamber. The fabric speed was 28yds/min and the unit held one yard of fabric giving a treatment time of approx 2 seconds. The ammonia gas flow used was equivalent to 2.25 moles $NH_3$/mole P.

After curing, one sample of fabric was passed directly into a 15% solution of hydrogen peroxide (35%) which effectively stops any further polymerisation reaction. The total time available for curing was approximately 10 seconds. A second sample was not subjected to this peroxide treatment. Both samples were batched, allowed to stand overnight and then washed off in 0.5g/l nonionic detergent plus 2% of $H_2O_2$ (35%). Both samples satisfied the requirements of British Standards 3120 and 3121 both before and after washing. The % P content of the two washed-off samples was virtually identical, being 2.74% for the peroxide treated and 2.75% fortthe sample which was allowed to stand between gas curing and washing off.

The P and N analysis figures for these fabrics are shown in Table 3.

Table 3

| Stage | % P | % N | N/P molar | % P Efficiency |
|---|---|---|---|---|
| After gas curing | 2.97 | 3.17 | 2.36 | — |
| After washing off | 2.75 | 2.29 | 1.84 | 92.8 |
| After $H_2O_2$plus wash off | 2.74 | 2.64 | 2.13 | 92.4 |

EXAMPLE 4

A cotton drill fabric weighing 270g/sq m was padded in a solution of a THPC/urea pre-condensate to give an uptake of 21.1% THPC. It was dried and cured as in the previous Example, but using an ammonia gas flow equivalent to 2.48 moles $NH_3$/mole P. One sample was allowed to stand overnight before washing off whilst a second sample was passed directly from the cure unit into $H_2O_2$ solution and batched wet overnight before washing off.

Both samples gave good flame resistance, meeting the requirements of BS 3120 and BS 3121 both before and after washing. The peroxide treated sample gave slightly better phosphorus efficiency than the sample which was allowed to stand after curing, as shown in Table 4.

Table 4

| Stage | % P | % N | N/P molar | % P Efficiency |
|---|---|---|---|---|
| After gas curing | 2.50 | 2.49 | 2.20 | — |
| After washing off | 1.98 | 2.02 | 2.26 | 79.3 |
| After $H_2O_2$plus wash off | 2.35 | 2.18 | 2.05 | 94.0 |

EXAMPLE 5

A dyed cotton drill fabric weighing 260g/sq m was padded in a solution of a THPC/urea pre-condensate to give an uptake of 23.3% THPC. After tenter drying the fabric was cured in a curing unit as illustrated at a speed of 19 yds/min and an ammonia flow equivalent to 2.4 moles $NH_3$/mole P. The cured fabric was scoured on a jig in 2½ lbs NaOH, 11 lbs 100 vol. $H_2O_2$ and 4 oz of nonionic detergent in 50 gallons of water at 60° C., rinsed well and dried.

The treated fabric was flame resistant to the requirements of BS 3120 both before and after washing. The following analytical results were obtained, showing good phosphorus retention during processing and after 12 BS 3120 washes.

Table 5

| Stage | % P | % N | N/P molar ratio | % P Retention |
|---|---|---|---|---|
| After gassing | 2.88 | 3.02 | 2.32 | — |
| Washed off | 2.42 | 2.19 | 2.00 | 84% |
| After 12 BS 3120 washes | 2.35 | 2.33 | 2.10 | 97% |

EXAMPLE 6

A cotton flannelette fabric weighing 170g/sq m was padded in a solution of a THPC/urea pre-condensate and dried by a commercial finisher. This fabric was cured on the curing unit as illustrated at a speed of 28yds/min and a flowrate equivalent to 2.3 moles $NH_3$/mole P. Samples A, B and C, were taken after curing and after final washing-off and were analysed for P & N content. The final fabric had good flame resistance, meeting the requirements of BS 3120 both before and after washing, and showed good phosphorus efficiency.

Table 6

| | Sample | % P | % N | N/P ratio | % P Efficiency |
|---|---|---|---|---|---|
| A | Cured only | 3.18 | 3.60 | 2.50 | — |
| | Washed off | 2.95 | 2.94 | 2.20 | 92.9 |
| B | Cured only | 3.25 | 3.63 | 2.47 | — |
| | Washed off | 2.94 | 3.03 | 2.28 | 90.5 |
| C | Cured only | 3.14 | 3.85 | 2.71 | — |
| | Washed off | 2.85 | 3.00 | 2.33 | 90.8 |

We claim:

1. A process for flameproofing cellulosic fabrics in a closed chamber, wherein the fabric is impregnated with an aqueous solution of a tetrakis hydroxymethyl phosphonium salt, comprising in combination passing said impreganted fabric through said closed chamber;

introducing gaseous ammonia into said chamber through at least one duct having one or more orifices and passing said impregnated fabric in contact with said duct and over said orifices; said orifices being so positioned that the gaseous ammonia passing through said orifices contacts said impregnated fabric and passes through said impregnated fabric; and passing condensed water formed in said chamber to a water-receiving means without said water contacting said impregnated fabric.

2. The process of claim 1 wherein said fabric which is passed through said chamber remains in said chamber for between about two and three seconds.

3. The process of claim 1, wherein said tekerkis hydroxymethyl phosphonium salt is condensed with a nitrogen-containing compound.

4. A process as claimed in claim 3, wherein the rate of feed of the ammonia is such the 1.5–2.5 moles are provided per mole of said salt present in said impregnated fabric.

5. The process of claim 3, wherein said duct is a perforated roller.

6. The process of claim 3 comprising passing said gaseous ammonia through said orifices and through said impregnated fabric over the entire width of said impregnated fabric.

7. The process of claim 3, wherein said chamber has an inclined surface and passing said condensed water along said inclined surface to a liquid-containing means in said chamber.

8. The process of claim 3 wherein said nitrogen-containing compound is selected from the group consisting of melamine, quanidine, and urea.

9. The process of claim 8, wherein said salt is tetrakis hydroxymethyl phosphonium chloride.

10. The process of claim 9, wherein said nitrogen-containing compound is urea.

11. A process as claimed in claim 10, wherein the rate of feed of the ammonia is such the 1.5–2.5 moles are provided per mole of said salt present in said impregnated fabric.

12. A process as claimed in claim 11 wherein the speed at which the fabric is passed through the chamber is 20–30 yds/minute.

13. A process as claimed is claim 12 wherein the impregnated fabric is dried to a water content of 5–15% before entering the chamber.

14. The process of claim 13, wherein said impregnated fabric in said closed chamber is passed sequentially in contact with two of said ducts and each of said ducts is a roller having orifices over its entire width in contact with said impregnated fabric.

15. The process of claim 12 wherein said fabric which is passed through said chamber remains in said chamber for between about two and three seconds.

* * * * *